US005437299A

United States Patent [19]

Kolpak

[11] Patent Number: 5,437,299

[45] Date of Patent: Aug. 1, 1995

[54] MULTIPHASE FLUID FLOW SPLITTING AND MEASUREMENT

[75] Inventor: Miroslav M. Kolpak, Dallas, Tex.

[73] Assignee: Atlantic Richfield Company, Los Angeles, Calif.

[21] Appl. No.: 255,032

[22] Filed: Jun. 7, 1994

[51] Int. Cl.[6] ..... F17D 1/00

[52] U.S. Cl. ..... 137/1; 137/552; 137/561 A; 137/876

[58] Field of Search ..... 137/1, 2, 3, 88, 561 A, 137/552, 876

[56] References Cited

U.S. PATENT DOCUMENTS

| | | | |
|---|---|---|---|
| 1,765,984 | 6/1930 | Kocourek | 137/876 X |
| 3,794,056 | 2/1974 | Warren | 137/561 A |
| 4,269,211 | 5/1981 | Howard | 137/876 X |
| 4,505,297 | 3/1985 | Leech | 137/561 A |
| 4,522,218 | 6/1985 | Konak | 137/3 |
| 4,528,919 | 7/1985 | Harbolt | 137/561 A X |
| 4,662,391 | 5/1987 | Tolley | 137/561 A X |
| 4,800,921 | 1/1989 | Greebe | 137/561 A |
| 4,824,614 | 4/1989 | Jones | 137/561 A X |
| 5,251,662 | 10/1993 | Rubel | 137/561 A X |

*Primary Examiner*—Robert G. Nilson
*Attorney, Agent, or Firm*—Michael E. Martin

[57] ABSTRACT

Multiphase fluid flow, such as gas and water, is controlled to provide splitting the flow from a supply conduit into one or more branch conduits with a predetermined gas-to-liquid ratio in the branch conduits by providing a flow mixing device interposed in the main conduit at the intersection of the main conduit with the branch conduits and a variable area orifice provided by a sleeve type closure member to effectively regulate the gas-to-liquid ratio entering the branch conduit. Gas to liquid ratios may be varied by providing the branch conduits as swivel connections to the main conduit so that the entry portion of the branch conduit may be oriented vertically upward or downward or at a selected position in between. Gas-to-liquid ratios may be measured by flowmeters and differential pressure gauges located upstream and downstream of the intersections of the branch conduits with the main supply conduit or manifold.

17 Claims, 2 Drawing Sheets

MULTIPHASE FLUID FLOW SPLITTING AND MEASUREMENT

BACKGROUND OF THE INVENTION

FIELD OF THE INVENTION

The present invention pertains to a system for maintaining representative multiphase fluid flow (constant gas-to-liquid ratio) through a conduit system having one or more branch conduits, an arrangement for modifying the gas-to-liquid ratio in the flowstream flowing through the branch conduit and a method for measurement of the gas-to-liquid ratio and flow of gas and liquid at selected locations in the system.

BACKGROUND

Many types of fluid handling and transport systems require or experience multiphase (gas and liquid) fluid flow. In oil and gas production, for example, the fluids produced from subterranean earth formations may comprise mixtures of gas and liquid wherein a substantial portion of the liquid phase may comprise water. Fluid flow handling and transport systems for this type of multiphase fluid may require representative flow splitting, modification of the gas-to-liquid ratio and measurement of the gas-to-liquid ratio in the flowstream.

More importantly, perhaps, there has been a need to develop systems for handling and transport of multiphase fluid such as in the reinjection of produced gas from earth formations. U.S. patent application Ser. No. 08/227,837, filed Apr. 14, 1994, and entitled "Simultaneous Water and Gas Injection Into Earth Formations" by Richard F. Stoisits, et al, and assigned to the assignee of the present invention, is directed to a unique system for injecting a mixture of produced gas and water into an earth formation for storage of the gas with reduced mobility and for stimulating the production of oil in the formation. As described in the abovementioned patent application, certain problems arise in providing simultaneous water and gas injection into a subterranean formation through one or more injection wells. For example, uniform distribution of the gas and liquid mixture is difficult to maintain when the mixture must be transported long distances through piping networks and manifolds. Accordingly, there has developed a need to be able to provide substantially constant proportions of gas and liquid when the multiphase fluid flow is split into several different distribution conduits from a main supply conduit or manifold, for example. Moreover, there has also developed a need to be able to control the gas-to-liquid ratio in certain instances and to measure the gas-to-liquid ratio of the fluid flowstream at selected points in the transport or distribution network. It is to these ends that the present invention has been developed.

SUMMARY OF THE INVENTION

The present invention provides a unique system for splitting or diverting a portion of the flow of a multiphase (gas and liquid) flowstream in a conduit system into one or more branch conduits from a so-called main supply conduit.

In accordance with an important aspect of the present invention, a device is provided which is inserted in a multiphase fluid flow distribution conduit which includes a branch conduit extending therefrom and is characterized by a static flow mixer interposed in the main fluid flowstream and a variable orifice for controlling the velocity of flow into the branch conduit and to prevent separation and reingestion into the main supply conduit of separated liquid or gas.

The device includes an arrangement wherein a variable orifice or closure member is selectively positioned to control the orifice size interconnecting the main supply conduit and the branch conduit. The closure member is preferably a sleeve type closure rotatably mounted in the main supply conduit and which may be of a preselected inside diameter so as to provide a flow restriction to maintain a certain minimum velocity of fluid flow through the main conduit as well as the branch conduit.

In accordance with another important aspect of the present invention, a multiphase fluid flow handling and distribution system is provided wherein a branch conduit intersects the main supply conduit at a point whose position may be varied between an upward facing point of intersection between the branch conduit and the main supply conduit and a downward facing point of intersection whereby the gas-to-liquid ratio of the fluid flowing into the branch conduit may be selectively varied in accordance with the position of the point of intersection. The gas-to-liquid ratio may also be controlled by a valve wherein the position of a closure member which controls the orifice size of the opening into the branch conduit may be selectively controlled to change the orifice size and control the gas-to-liquid ratio of the fluid entering the branch conduit and flowing on through the main conduit.

Still further, the present invention provides a relatively uncomplicated method for measuring the flow rate of liquid and gas at one or more points in the multiphase fluid flow handling system of the present invention by the combination of a flow-mixing device, a flowmeter interposed in the conduit generally downstream of the mixing device and a differential pressure gauge mounted so as to measure the hydrostatic pressure difference between the upper and lower inner surfaces of the conduit. The combined flow, the gas-to-liquid ratio and the gas and liquid volumetric flow rates may then be determined with reasonable accuracy over much of a practical gas-to-liquid ratio range as further set forth in a copending patent application entitled: Multiphase Fluid Flow Rate and Density Measurement by Miroslav M. Kolpak, et al, filed concurrently herewith.

Those skilled in the art will recognize the above features and advantages of the present invention, together with other superior aspects thereof upon reading the detailed description which follows in conjunction with the drawing.

DESCRIPTION OF PREFERRED EMBODIMENTS

Figures 1, 2, 3:
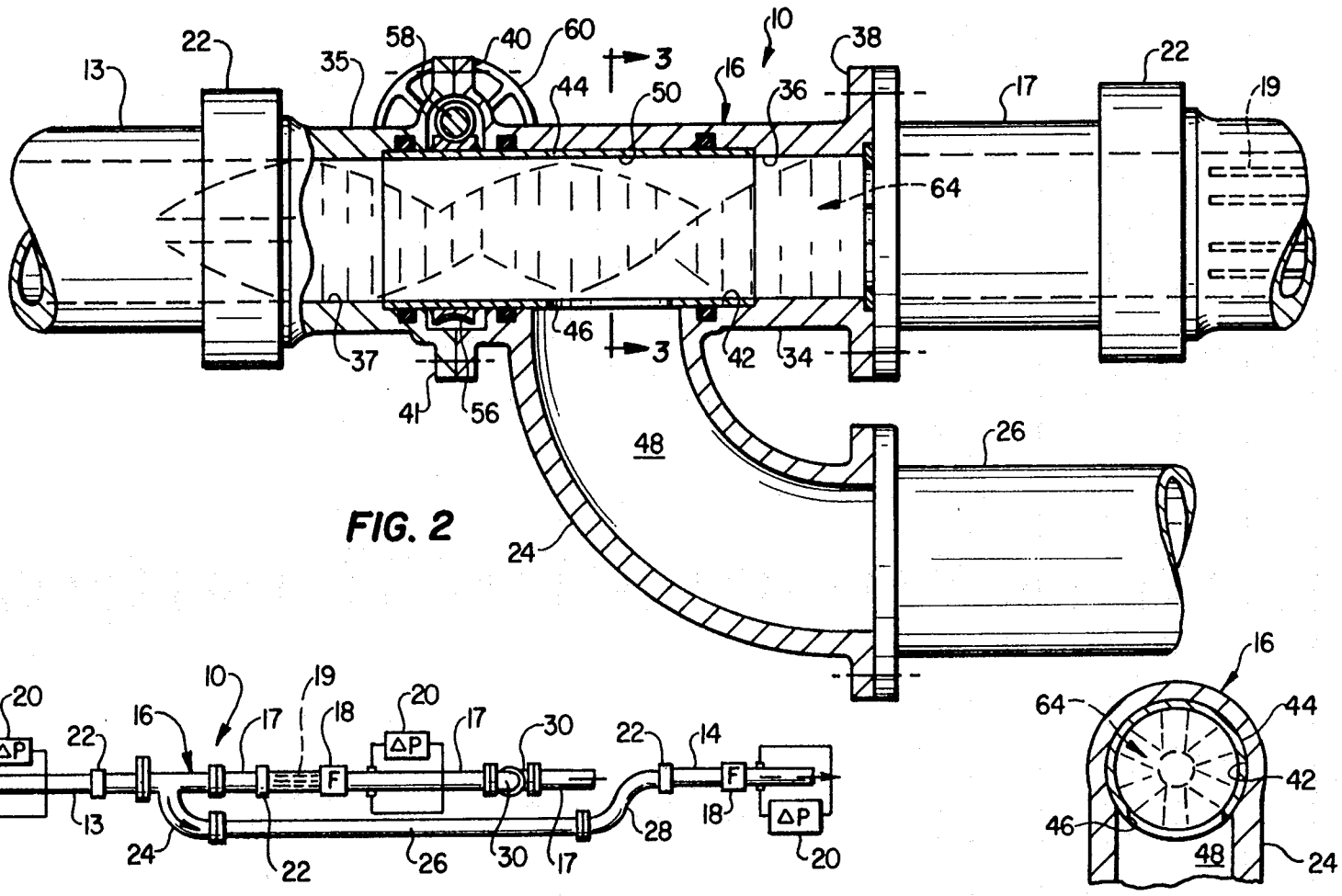
FIG. 1 is an elevation, in somewhat schematic form, of a multiphase fluid flow transport system in accordance with the present invention.
FIG. 2 is a detail view, partially sectioned, showing a device for providing representative flow splitting or selected gas-to-liquid ratios in the flow.
FIG. 3 is a section view taken from the line 3—3 of FIG. 2.

In the description which follows, like parts are marked throughout the specification and drawing with the same reference numerals, respectively. The drawing figures are not necessarily to scale in the interest of clarity and conciseness.

In certain multiphase fluid flow systems, such as the aforementioned system for reinjecting gas into a subterranean reservoir, it is desirable to have a system including a supply conduit with a mixture of gas and water flowing therethrough and which is connected to one or more branch conduits for conducting the gas-liquid mixture to selected injection wells. In such a system it is desirable to maintain the gas-liquid mixture conducted to each of the injection wells at a constant or preselected gas-to-liquid ratio, or percent by volume of gas in the mixture. In many instances it may be desirable to reduce or increase the gas-to-liquid ratio in one or more of the branch conduits. FIG. 1 is a somewhat schematic representation of a portion of a system for conducting a mixture of gas and liquid to one or more injection wells, for example. The system illustrated in FIG. 1 is generally designated by the numeral 10 and includes a so-called main multiphase fluid supply conduit 12 which is adapted to conduct a mixture of water and natural gas, for example, wherein the volumetric fraction of gas in the water is as much as twenty percent (20%) of the total fluid mixture. The direction of flow in the system 10 is indicated by the arrows in FIG. 1. The source of the gas-liquid mixture for flow through the supply conduit 12 is not shown in the interest of conciseness.

The supply conduit 12 is operably connected to a branch conduit 14 by way of a unique arrangement for controlling the gas-to-liquid ratio in the branch conduit 14 to be the same as that in the conduit 12 or to be selectively lesser or greater. The supply conduit 12 includes a section 13 which functions as an approach to a flow splitting device 16. A so-called run section 17 of the supply conduit 12 carries that portion of the gas-liquid mixture which is not conducted to the branch conduit 14 through the flow splitting device 16. The system 10 also includes, by way of example, one or more flowmeters 18 shown interposed in the approach conduit section 13, the run conduit section 17 and the branch conduit 14. The flowmeters 18 may, for example, be conventional turbine type meters or positive displacement flowmeters, both of a type commercially available. The approach portions of the conduits leading to the flowmeters 18 may have conventional flow straightening vanes 19 interposed in those conduit portions as shown by way of example for the conduit run section 17 illustrated. A differential pressure gauge 20 is disposed downstream of each of the flowmeters 18 and is adapted to measure the pressure differential between the top side of the conduit and the bottom side of the conduit to which it is connected.

In accordance with an important aspect of the present invention, the flow splitting device 16 is connected to the supply conduit 12 by spaced apart swivel joints 22 which may be of a type commercially available. A type of swivel joint which may be used in the system 10 is generally of the type described in U.S. Pat. No. 4,478,438, issued Oct. 23, 1984 to Peter Elorriaga, Jr. The type of swivel joint described in the Elorriaga, Jr. patent is similar to several types commercially available. The provision of the swivel joints 22 in the main conduit 12 provides for rotating the flow splitting device 16 so that a branch conduit 24 of the device comprising, by way of example, a curved conduit or elbow may be oriented to extend generally downwardly, generally upwardly or in a selective rotative position in-between. In this regard, the branch conduit part 24 of the device 16 is suitably connected to a conduit part 26, a so-called S conduit joint 28 and another swivel joint 22 interconnecting the joint 28 with the branch conduit 14. In this way, the assembly of the flow splitting device 16, the conduit part 26 and the joint 28 may be rotated about the central axis of the supply conduit 12 and the branch conduit 14 without requiring any movement of either one of these conduits. Accordingly, the run section 17 of the supply conduit 12 is required to have suitable elbow or angle joints 30 interposed therein to redirect the supply conduit around the branch conduit 14. In these respects, the system 10 is somewhat exemplary to illustrate one arrangement whereby a branch conduit may be connected to a main supply conduit in such a way that the initial portion of the branch conduit such as indicated by the section 24 may be selectively rotated to a position for controlling the gas fraction or gas-to-liquid ratio in the flow entering the branch conduit 14.

Referring now to FIGS. 2 and 3, the flow splitting device 16 is characterized by a generally cylindrical body 34 having a central bore 36 formed therein and extending between opposed flange portions 38 and 40. The body 34 also includes a suitable counterbore 42 for receiving an elongated rotatable sleeve 44 comprising a closure member. The sleeve 44 includes a generally cylindrical port 46 formed therein and operable to be in full registration with a passage 48 in the branch conduit part 24 of the device 16. The sleeve 44 has a cylindrical inside wall 50 which is of the same diameter as the bore 36 although the diameter of the inside wall 50 may be less than that of the bore 36 for purposes to be described herein. The body 34 includes a separable part 35 having a bore 37 coaxial with the bore 36 and forming an extension thereof. The body part 35 is secured to the body 34 along a flange 41 contiguous with the flange 40. The flanges 40 and 41 are provided with cooperating cavity portions for receiving a ring gear 56 secured to the sleeve 44 and meshed with a worm gear 58 operably rotated by suitable means such as a hand wheel 60 for rotatably positioning the sleeve 44 in a selected position of the port 46 with respect to the passage 48. In this way, the flow area of the port 46 effective for conducting fluid flow from the bore 36 into the passage 48 may be controlled at will. Suitable spaced apart seals are provided in the body 34 to provide fluid tight sealing of the sleeve 44 as illustrated in FIG. 2.

The system 10 also includes a suitable fluid mixer 64 interposed in the bore 36, 37 and extending through the closure sleeve 44. The mixer 64 may comprise plural axially spaced multi-bladed elements which are arranged in selected positions to provide for effective, thorough mixing of the multiphase fluid flowing through the system 10 and particularly through the device 16 so that at least thorough and even mixing of the gas and liquid occurs across the cross-section of the passageways of the conduits including the approach conduit section 13, the run conduit section 17 and the branch conduit section 24. The mixer 64 may be of a type commercially available and also described in U.S. Pat. No. 4,123,178, issued Oct. 31, 1978 to R. N. Salzman, et al. Other types of so-called static mixing devices may also be interposed in the system 10 in the position illustrated in FIG. 2, for example.

Tests of multiphase fluid flows of mixtures of natural gas (or similar gases) and water wherein the gas-to-liquid ratio is in a range up to about twenty percent (20%) gas by volume of the total mixture indicate that, to sustain thorough mixing of the gas and liquid, a fluid velocity in the conduit system should be on the order of 8.0 feet per second or greater. Accordingly, if a velocity is indicated to be less than about 8.0 feet per second, the size of the conduit must be reduced or the flow area of a mixing device should be reduced by inserting a cylindrical sleeve or the like in the conduit so as to raise the apparent or "superficial" velocity to at least the minimum indicated above. Accordingly, in the system 10, for example, the sleeve 44 could be provided with an inside wall 50 of a diameter such that, together with the mixer 64, the velocity flowing through the device 16 would be the minimum indicated. Alternatively, of course, the conduit cross-sectional flow area could be preselected to assure the minimum flow velocity if the minimum expected combined volumetric flow rate of gas and liquid was known.

Still further, it has been observed that, in order to sustain representative gas-to-liquid ratios in the flow which splits off from the flow in the main conduit 12, for example, through the conduit branch or elbow 24, certain means must be provided to assure a small pressure drop of the fluid flowing into the passage 48 so as to prevent reingestion of the gas or liquid back into the main conduit, including the conduit run section 17, resulting from local separation of gas and liquid in the branch. In this regard the device 16 is provided with the sleeve 44 having an orifice or port 46 formed therein whose effective cross-sectional flow area with respect to the passage 48 may be modified by rotating the sleeve 44 so that registration of the port with the passage 48 is increased or decreased to that which will provide a suitable pressure drop for fluid flow entering the passage 48.

Another solution to the separation problem is to assure that the effective or superficial velocity of the flow through the port or orifice 46 exceeds a certain minimum value which is indicated from tests to be about 15.0 feet per second for flow in a downward or horizontal direction into a branch conduit section such as the elbow 24 or, if the elbow 24 is located so that the flow into the passage 48 commences substantially vertically upwardly, the velocity should be on the order of about 25.0 feet per second. Since pressure drop or differential across an orifice or port, such as the port 46, is proportional to the velocity squared, the velocity requirement is equivalent to a pressure drop requirement. Tests indicate that the pressure drop or velocity requirement for so-called T-type pipe fittings or devices having a straight or curved branch conduit, such as the elbow 24, should be higher when the branch is disposed upwardly, rather than downwardly, as shown in the drawing figures. Accordingly, a constant gas fraction as a percent of the total fluid volumetric flow rate can be achieved if an orifice or flow restriction is sized so as to achieve either a minimum superficial velocity through the restriction or a minimum pressure drop between the passage 48 and the passage defined by the bores 36, 37, for example. The device 16 provides a suitable way of controlling the orifice size and the effective velocity or pressure drop between the flow in the main conduit 12 and the branch conduit 14 including the sections 24, 26, 28.

In certain operations it may be desirable to change the gas fraction or gas-to-liquid ratio in the flow being conducted to one or more branch conduits from a main supply conduit or manifold. For example, during injection of gas into a reservoir or earth formation from several injection wells, the need may arise to modify the gas or liquid fraction being conducted to one or more of the wells with respect to other wells. This so-called non-representative flow splitting may be accomplished with the device 16 by rotating the sleeve closure member 44 to reduce or increase the effective flow area of the port 46 as it registers with the passage 48 at the intersection of the passage 48 with the counterbore 42. By rotating the sleeve 44, the effective cross-sectional flow area of the port 46 may be increased or decreased to change the pressure drop of the flow between the bore 36, 37 and the passage 48 to thereby affect the degree of gas fraction in the multiphase fluid flow entering the passage 48. Thus, with suitable calibration, the closure sleeve 44 may be rotated to use the device 16 to change the gas-to-liquid ratio of the flow entering the branch conduit 14.

Still further, it has been observed that the orientation of the entry portion of the branch conduit, as represented by the elbow 24, may be effective in controlling the gas-to-liquid ratio of the flow entering the branch conduit. For example, with the branch conduit entry section or elbow 24 oriented to provide for flow into the passage 48 in a generally downward direction, the gas-to-liquid ratio will be less than if the elbow 24 is oriented directly upwardly or 180° displaced from the position shown in FIGS. 1 and 2 with respect to the central longitudinal axis of the conduit 12. Again, with calibration, the swiveled T-type connection formed by the device 16, including the main body 34 and the branch elbow 24, may be used to control the volumetric gas fraction of the fluid flow entering the branch conduit by orienting the body 34 so that the branch conduit is in an upward or downward direction or an intermediate position between these limit positions. In each of the abovementioned arrangements, it is considered of some importance to provide for thorough mixing of the multiphase fluid flow entering the device 16 as well as the flow through the device. Accordingly, the mixer 64 illustrated preferably extends through the device 16, as illustrated, and may extend upstream a suitable distance through the conduit approach section 13 to assure that the flow approaching the device 16 is thoroughly mixed.

The flow rate of liquid and gas in the mixture can be measured at one or more points in the system 10, as indicated by the locations of the flowmeters 18 and the differential pressure measuring devices 20. This may be advantageous in determining if the desired gas-to-liquid ratio of fluid flow is being conducted through the system including the conduit run section 17 and the branch conduit 14. It is preferable that a static mixer be located in the system upstream of the flowmeters 18 and the pressure differential measuring devices 20 at a distance which will assure that there is homogeneous fluid flow through the metering and pressure measurement devices. Moreover, in the case of the use of the device 16, a flow straightening device 19 may desirably be located downstream of the device 16 on the approach to the flowmeter 18. For the sake of discussion herein, it will be assumed that a suitable fluid mixing device is interposed in the system 10 upstream of each of the flowmeters 18 a sufficient distance, if needed at all, to assure homogeneous flow. The meters 18 are operable to measure the combined volumetric flow rate (the flow rate of the gas and liquid mixture). The densities of the liquid and gas are assumed or separately measured at the flow conditions in the system 10 and the diameter (or cross sectional flow area) of the passage in the conduit, such as the run section 17, the branch conduit 14 and the main supply conduit 12, are to be determined at the point where the pressure differential is measured. The gas-to-liquid ratio (GLR) is the ratio of the volumetric flow rate of gas ($Q_g$) divided by the total flow ($Q_g+Q_l$) where ($Q_l$) is the liquid volumetric flow rate. The pressure measurement devices 20 will provide the hydrostatic pressure differential between the top and bottom inner surfaces of the conduit sections to which they are connected, respectively. The gas-to-liquid ratio in the combined flowstream can be computed from the following equation:

$$GLR = \frac{(dl - dg)}{(dP/D - dg)}$$

in which dl and dg are the densities of the liquid and gas, respectively, (in pounds per cubic foot), D is the diameter of a cylindrical conduit at the point where the pressure difference is measured (in feet), and dP is the measured pressure difference (in pounds per foot squared). Accuracies in the range of about ten percent (10%) should be achievable over much of a practical gas-to-liquid ratio range including the range indicated above wherein the volumetric fraction of gas in the total mixture is less than about twenty percent (20%).

The respective gas and liquid volumetric flow rates are thus:

$$Q_l = Q_m(1 - GLR)$$

$$Q_g = Q_m(GLR)$$

where $Q_m$ is the volumetric flow rate measured by a flowmeter 18.

By monitoring the gas-to-liquid ratios at the various points indicated in the system 10, as illustrated in FIG. 1, the device 16 and/or the orientation of the portion of the branch conduit defined by the elbow 24, the conduit section 26 and the S joint 28 may be used to maintain the gas-to-liquid ratio in the run section 17 as well as the branch conduit 14 substantially constant and equal or to modify the gas-to-liquid ratio of the fluid flow in these respective conduits. While monitoring the gas-to-liquid ratio, the device 16 may be operated to rotate the sleeve 44 to change the effective flow area of the port 46, for example. Moreover, in place of or in addition to positioning the sleeve 44, the elbow part 24 may be moved between a downwardly oriented position and an upwardly oriented position or a position in between to change the gas-to-liquid ratio of the fluid flowing through the branch conduit 14.

Figure 4:
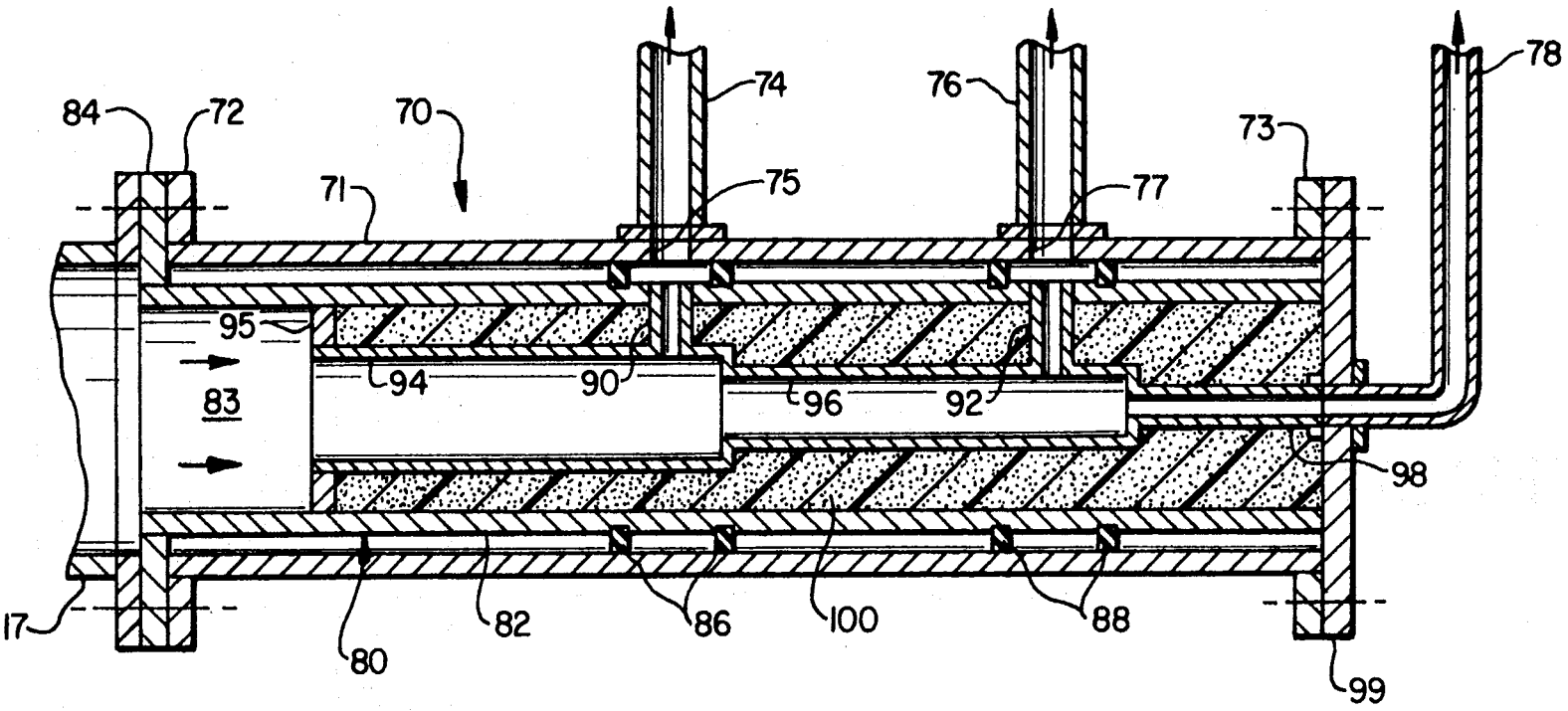
FIG. 4 is a section view of a manifold adapted to maintain a desired gas-to-liquid ratio in branch conduits of a system in accordance with the invention.

Referring now to FIG. 4, there is illustrated an arrangement wherein an existing or new manifold might be in communication with a main fluid supply conduit such as the conduit 12 and modified in such a way as to maintain sufficient velocity of the fluid mixture flowing to a plurality of branch conduits so as to maintain the desired gas-to-liquid ratio in each of the branch conduits. In the arrangement of FIG. 4, there is illustrated a manifold 70 comprising a generally cylindrical pipe member 71 having spaced apart flange portions 72 and 73 and branch conduits 74 and 76 suitably connected thereto for receiving fluid flow through ports 75 and 77, respectively.

In the event that it is desired to modify the manifold 70 so that substantially constant gas-to-liquid ratios would be maintained of a fluid mixture flowing to the branch conduits 74 and 76 and possibly also a branch conduit 78, the manifold 70 is modified as illustrated. For example, the manifold 70 might be connected to the conduit run 17 of the supply conduit 12 and, in order to maintain a constant gas-to-liquid ratio of the flowstream flowing through the branch conduits 74, 76 and 78, a conduit insert 80 is provided which is characterized by a cylindrical pipe section 82 having a transverse end flange 84 connected thereto and spaced apart sets of annular seal rings 86 and 88 suitably secured thereon. The seal rings 86 and 88 have an outside diameter such that the insert 80 may be disposed in the manifold member 71 in the position shown wherein the sets of seal rings 86 and 88 are spaced apart such that the ports 75 and 77 are placed in flow communication with respective branch conduit portions 90 and 92, as illustrated.

The manifold insert 80 also includes axially aligned conduit parts 94, 96 and 98 which are of proportionately reduced diameters such that the flow velocity of a multiphase fluid flowstream entering the conduit sections 94, 96 and 98 from a passage 83 within the manifold insert 82 is maintained at a sufficient velocity to minimize changes in the gas-to-liquid ratio. As mentioned previously, a flow velocity of a gas-water mixture of about 15.0 feet per second is indicated to be necessary to prevent separation of gas and liquid or a change in the gas-to-liquid ratio of the flowstream. As a portion of the flow of the fluid mixture is taken off at each of the conduits 74, 76 and 78, the effective cross-sectional flow areas of the conduit portions 94, 96 and 98 must be proportionately reduced to maintain the desired flow velocities.

As illustrated, the conduit section 78 is suitably secured to a flange 99 which may be secured to the flange 73 and aligned with the reduced diameter conduit portion 98 of the manifold insert 80 to receive flow therefrom. The conduit portions 94, 96 and 98 may be positioned in the manifold insert 82 by a suitable flange 95, for example. A suitable insulating material 100, such as styrene or polyurethane foam may be injected into the space between the manifold insert 82 and the conduit portions 94, 96 and 98, as illustrated, if necessary.

The system 10 may be constructed using conventional materials used for piping and valve devices for conducting mixtures of water and gas and other similar fluids. Although a preferred embodiment in accordance with the invention has been described in detail herein, those skilled in the art will recognize that various substitutions and modifications may be made without departing from the scope and spirit of the invention as set forth in the appended claims.

What is claimed is:

1. A system for maintaining representative multiphase flow through a conduit system having one or more branch conduits, wherein said multiphase fluid flow comprises gas and liquid, said system comprising (a) a main supply conduit including an approach section, (b) a branch conduit intersecting said supply conduit and a run section of said supply conduit, said run section and said branch conduit being operable to conduct multiphase fluid flow which has been split from said multiphase fluid flow in said approach section to at least one said branch conduit;

(c) a gas-to-liquid ratio controller for controlling the gas-to-liquid ratio in said multiphase fluid flow entering at least one of said branch conduit and said run section wherein said gas-to-liquid ratio controller comprises a closure member operable to provide fluid flow communication of said branch conduit with said supply conduit, said closure member comprising a sleeve supported in a body of a flow splitting device interposed in said supply conduit and connected to said branch conduit, said sleeve being rotatable to vary the effective size of an orifice formed in said sleeve and in communication with a passage in said branch conduit to selectively control one of the flow velocity of fluid entering said branch conduit and a pressure differential between said branch conduit and said approach section.

2. The system set forth in claim 1 wherein:

the effective diameter of an inside wall of said sleeve is predetermined to maintain a predetermined minimum velocity of flow in said run section.

3. The system set forth in claim 1 including:

a fluid flow mixer interposed in said sleeve.

4. The system set forth in claim 1 or 2 including:

a fluid flow mixer interposed in said approach section.

5. In a system for conducting multiphase fluid flow comprising gas and liquid a main supply conduit including an approach section a branch conduit intersecting said supply conduit and a run section of said supply conduit said run section and said branch conduit being operable to conduct multiphase fluid flow which has been split from said multiphase fluid flow in said approach section and a gas-to-liquid ratio controller for the fluid flow entering at least one of said branch conduit and said run section, wherein: said gas-to-liquid ratio controller comprises a swivel member interposed in said supply conduit and including a branch part comprising said branch conduit, said swivel member being operable to be oriented such that said branch part may be positioned generally downwardly, generally upwardly and in a selected position in between said upwardly or downwardly positions to control the volumetric gas fraction of fluid flowing through said branch conduit.

6. The system set forth in claim 5 including:

means for measuring the gas-to-liquid ratio of the fluid flowing through at least one of said approach section, said run section and said branch conduit comprising a flowmeter and a differential pressure measurement device for measuring the differential pressure between a top side of said one of said approach section, said run section and said branch conduit and the bottom side of said one of said approach section, said run section and said branch conduit, respectively.

7. In a system for conducting a mixture of water and gas through a supply conduit to selected destinations of said mixture, a swivel member interposed in said supply conduit including a body having a branch conduit part formed thereon and having a passage intersecting a passage in said body defining a flowpath of said supply conduit, said branch part of said member being operably connected to a branch conduit for conducting part of a water and gas mixture from said supply conduit, said member being operable to be positioned in a selected position of said branch part between a downwardly extending position and an upwardly extending position to selectively control the gas-to-liquid ratio of the fluid flowing into said branch conduit.

8. The system set forth in claim 7 including:

a fluid mixer interposed in said supply conduit at the point of intersection of said branch part with said supply conduit to mix the fluid flowing therethrough.

9. In a conduit system for conducting a flowstream of a mixture of gas and liquid, a supply conduit and a branch conduit operably connected to said supply conduit to receive fluids therefrom, means for controlling the gas-to-liquid ratio in said branch conduit comprising a mixer interposed in said main conduit and extending across an intersection of said branch conduit with said main conduit and means forming an orifice interposed at said intersection of said branch conduit with said main conduit for effecting at least one of a change in velocity and a pressure differential between flow in said main conduit and said branch conduit to control the gas-to-liquid ratio of the flow entering said branch conduit.

10. The invention set forth in claim 9 wherein:

said fluid comprises gas and water and said main conduit has an effective cross-sectional flow area to provide a minimum fluid velocity in said main conduit, and said orifice is predetermined to provide a velocity in said branch conduit greater than said minimum velocity in said main conduit.

11. The invention set forth in claim 10 wherein:

said minimum velocity in said main conduit is about 8.0 feet per second.

12. The invention set forth in claim 10 wherein:

the velocity of said fluid in said branch conduit is not less than about 15.0 feet per second.

13. In a conduit system for conducting a flowstream of a mixture of gas and liquid, a supply conduit and a manifold member operably connected to said supply conduit to receive fluids therefrom, said manifold member including a plurality of branch conduits connected thereto for conducting said mixture of gas and liquid from said manifold and a manifold insert including a conduit part having plural sections of progressively reduced diameter adapted to be in communication with said branch conduits, respectively, to provide for conducting a flow of said mixture to each of said branch conduits at a predetermined minimum velocity to maintain the gas-to-liquid ratio of said mixture at a predetermined amount.

14. The invention set forth in claim 13 wherein:

said manifold insert includes a generally cylindrical member having a plurality of seal rings disposed thereon engaged with said manifold member and spaced apart in such a way as to provide passages from said conduit part to said branch conduits, respectively.

15. The invention set forth in claim 14 wherein:

said conduit part includes a flange portion for supporting said conduit part in said manifold insert.

16. A method for controlling the gas-to-liquid ratio in a mixture of gas and water flowing through a conduit system including a main conduit and at least one branch conduit intersecting said main conduit to conduct a portion of said mixture away from said main conduit, comprising the steps of:

maintaining a minimum fluid velocity in said main conduit at a point of intersection of said main conduit with said branch conduit of at least about 8.0 feet per second;

providing an effective cross-sectional flow area of the intersection of said branch conduit with said main conduit sufficient to provide a fluid velocity of fluid entering said branch conduit of at least about 15.0 feet per second so as to provide a gas-to-liquid ratio of fluid in said branch conduit substantially the same as the gas-to-liquid ratio of the fluid flowing in said main conduit and.

providing means forming an orifice at said intersection of said branch conduit with said main conduit, said means being operable to vary the effective cross-sectional flow area of said orifice to change the gas-to-liquid ratio of fluid flow entering said branch conduit at will.

17. A method for controlling the gas-to-liquid ratio in a mixture of gas and water flowing through a conduit system including a main conduit and at least one branch conduit intersecting said main conduit to conduct a portion of said mixture away from said main conduit, comprising the steps of:

maintaining a minimum fluid velocity in said main conduit at a point of intersection of said main conduit with said branch conduit of at least about 8.0 feet per second;

providing an effective cross-sectional flow area of the intersection of said branch conduit with said main conduit sufficient to provide a fluid velocity of fluid entering said branch conduit of at least about 15.0 feet per second so as to provide a gas-to-liquid ratio of fluid in said branch conduit substantially the same as the gas-to-liquid ratio of the fluid flowing in said main conduit and orienting such branch conduit in a selected position between a substantially vertically upward position and a substantially vertically downward position to selectively control said gas-to-liquid ratio.

* * * * *